US009097080B2

(12) United States Patent
Wilie

(10) Patent No.: US 9,097,080 B2
(45) Date of Patent: Aug. 4, 2015

(54) RISER CUTTING TOOL

(71) Applicant: SHELL OIL COMPANY, Houston, TX (US)

(72) Inventor: Curtis Len Wilie, Friendswood, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/380,049

(22) PCT Filed: Feb. 20, 2013

(86) PCT No.: PCT/US2013/026774
§ 371 (c)(1),
(2) Date: Aug. 20, 2014

(87) PCT Pub. No.: WO2013/126358
PCT Pub. Date: Aug. 29, 2013

(65) Prior Publication Data

US 2015/0041144 A1 Feb. 12, 2015

Related U.S. Application Data

(60) Provisional application No. 61/601,874, filed on Feb. 22, 2012.

(51) Int. Cl.
*E21B 29/02* (2006.01)
*E21B 29/12* (2006.01)

(52) U.S. Cl.
CPC ..... *E21B 29/02* (2013.01); *E21B 29/12* (2013.01)

(58) Field of Classification Search
CPC ..... E21B 29/02; E21B 29/12; E21B 43/117
USPC ..... 166/340, 361, 365, 297, 55, 55.6; 83/54
See application file for complete search history.

(56) References Cited

U.S. PATENT DOCUMENTS

| | | | | | |
|---|---|---|---|---|---|
| 3,336,759 | A | * | 8/1967 | Cooper | 405/227 |
| 3,951,218 | A | | 4/1976 | Sjogren | |
| 4,323,117 | A | * | 4/1982 | Pierce | 166/55 |
| 4,619,556 | A | * | 10/1986 | Parra | 405/195.1 |
| 4,724,105 | A | * | 2/1988 | Owen | 264/3.1 |
| 5,054,555 | A | | 10/1991 | Lalande | |
| 5,253,585 | A | | 10/1993 | Hudak et al. | |
| 5,777,257 | A | * | 7/1998 | Kenny | 102/312 |
| 6,131,517 | A | * | 10/2000 | Poe | 102/307 |

(Continued)

OTHER PUBLICATIONS

PCT International Search Report, Application No. PCT/US2013/026774 dated Jun. 26, 2013.

*Primary Examiner* — Matthew Buck

(57) ABSTRACT

A method of separating a riser, comprising providing a riser having an inner and an outer surface, a circumference of said outer surface, a longitudinal axis and a first end and a second end; radially surrounding said riser with an explosive shaped charge material, wherein said shaped charge explosive material is capable of generating a high-velocity plasma jet in response to an activation signal, and wherein said explosive material comprises an electrically conductive layer; transmitting said activation signal to said explosive material; generating said high-velocity plasma jet; and separating said riser into a first portion comprising said first end and a second portion comprising said second end when said high-velocity plasma jet penetrates said outer surface of said riser and exits said inner surface of said riser.

13 Claims, 2 Drawing Sheets

(56) References Cited

U.S. PATENT DOCUMENTS

| | | | | |
|---|---|---|---|---|
| 6,230,627 | B1 * | 5/2001 | Poe | 102/307 |
| 6,460,463 | B1 * | 10/2002 | Parrott et al. | 102/312 |
| 6,805,056 | B1 * | 10/2004 | Poe | 102/307 |
| 7,073,448 | B2 * | 7/2006 | Bell | 102/306 |
| 7,410,003 | B2 | 8/2008 | Ravensbergen et al. | |
| 7,661,367 | B2 * | 2/2010 | Yang et al. | 102/306 |
| 7,779,760 | B2 | 8/2010 | Konig | |
| 2010/0147519 | A1 * | 6/2010 | Goodman | 166/297 |
| 2011/0284237 | A1 * | 11/2011 | Baugh | 166/365 |

* cited by examiner

RISER CUTTING TOOL

CROSS-REFERENCE TO RELATED APPLICATIONS

The present application is a National Stage (§371) application of PCT/US2013/026774, filed Feb. 20, 2013, which claims the benefit of U.S. Provisional Application No. 61/601,874, filed Feb. 22, 2012, both of which are incorporated herein by reference.

FIELD OF THE INVENTION

The invention is directed towards a method for separating a riser, particularly when the riser is a riser connecting a subsea wellhead to a floating vessel.

BACKGROUND

U.S. Pat. No. 5,253,585 discloses that a main charge of explosive is positioned symmetrically about a passageway-forming tubular member, such as a well pipe assembly. The charge is outwardly and radially spaced from the member and is coupled thereto by a dense medium, such as soil, which is adapted to transfer the produced explosive energy to the tubular member in the form of a pressure pulse applied by the medium. Initiation charges are supplied at the outer surface of the main charge, to initiate a detonation wave directed at the tubular member. A layer of dense medium is provided to confine the non-coupled surface of the charge and retard venting of explosive gases away from the tubular member. In the end result, concentrated, converging pressure pulses are applied to the tubular member on detonation, to cause it to be symmetrically crimped to restrict the passageway. U.S. Pat. No. 5,253,585 is herein incorporated by reference in its entirety.

U.S. Pat. No. 7,779,760 discloses a shaped charge assembly that comprises a housing, first shaped charge, a wave shaping relay charge and a second shaped charge located in the housing. The assembly is configured such that a first active element formed by initiation of the first shaped charge causes detonation of the wave shaping relay charge, which in turn causes initiation of the second shaped charge to form a second active element. The first active element moves beyond a second end of the housing to cause damage of a first kind to an external target and the second active element also moves beyond the second end to cause damage of a second kind to the target. Shaped charges are known in the art, and U.S. Pat. No. 7,779,760 is one example. U.S. Pat. No. 7,779,760 is herein incorporated by reference in its entirety.

There is a need in the art for one or more of the following:

Improved systems and methods for severing risers;

Improved systems and methods for remotely severing risers;

Improved systems and methods for remotely severing risers when the risers are risers connecting a floating vessel to a subsea wellhead

SUMMARY OF THE INVENTION

The invention provides a method of separating a riser, comprising providing a riser having an inner and an outer surface, a circumference of said outer surface, and a first end and a second end; radially surrounding said riser with an explosive shaped charge material, wherein said explosive shaped charge material is capable of generating a high-velocity plasma jet in response to an activation signal, and wherein said explosive material comprises an electrically conductive layer; transmitting said activation signal to said explosive material; generating said high-velocity plasma jet; and separating said riser into a first portion comprising said first end and a second portion comprising said second end when said high-velocity plasma jet penetrates said outer surface of said riser and exits said inner surface of said riser.

BRIEF DESCRIPTION OF THE DRAWINGS

So that the features and advantages of the present invention can be understood in detail, a more particular description of the invention may be had by reference to the embodiments thereof that are illustrated in the appended drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION

This invention provides a way to disconnect a surface structure from the BOP stack located on a wellhead. A hydraulic disconnect system is normally used for this disconnection, but it the riser angle is greater than 3%, then the hydraulic system will not disconnect. This would result in the inability to disconnect the surface structure from the BOP stack and the wellhead which would likely result in damage to the BOP stack. This invention addresses this problem and provides for the ability to disconnect the riser from the BOP stack by cutting the riser with a riser cutting tool.

Presently preferred embodiments of the invention are shown in the above-identified figures and described in detail below. Embodiments may be described with reference to certain features and techniques for use on wells in a subsea environment.

Figure 1:
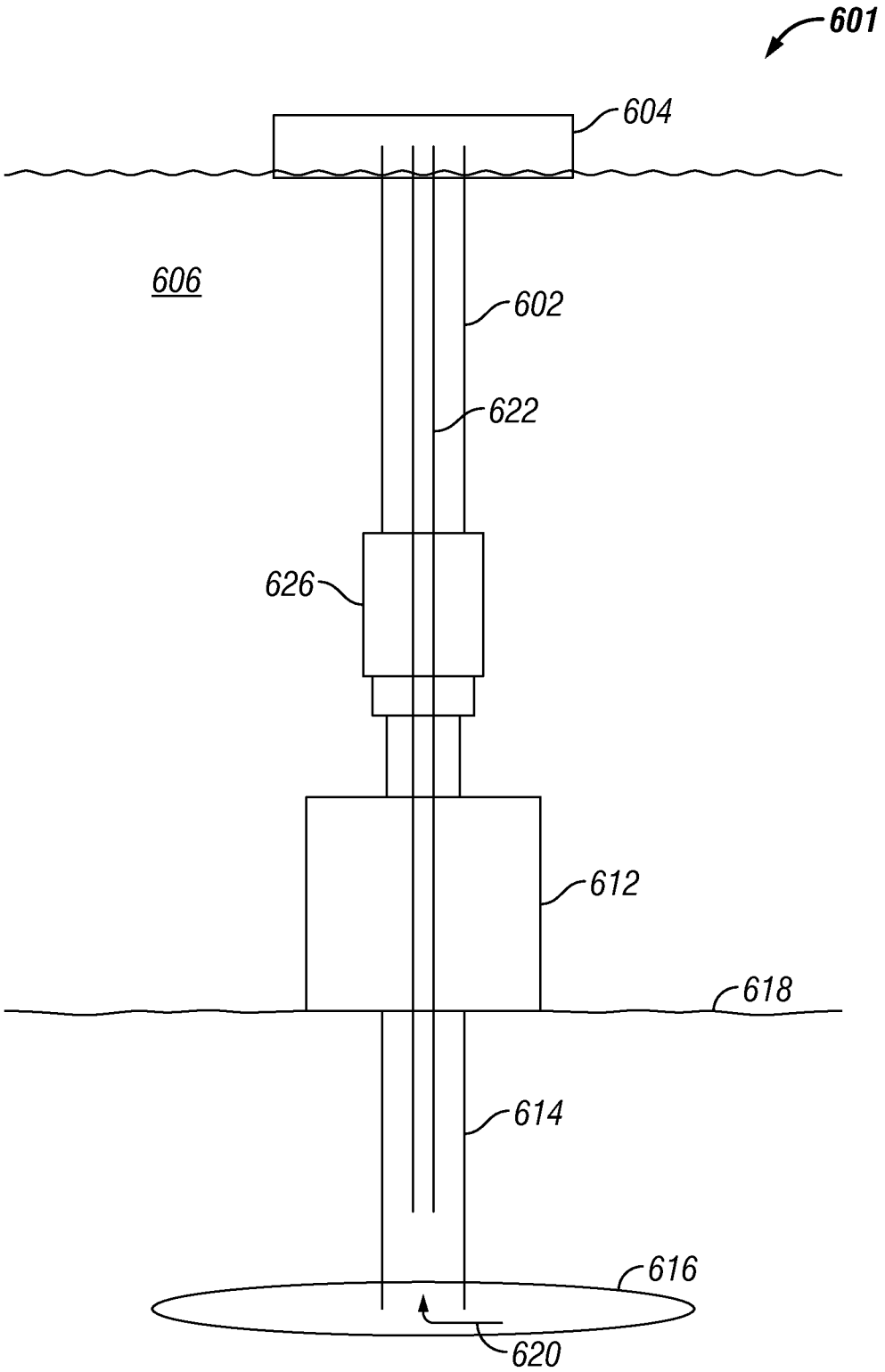
FIG. 1 is a schematic diagram depicting one embodiment of the riser cutting tool positioned above a subsea reservoir.

FIG. 1:

FIG. 1 depicts an embodiment of the riser cutting tool 626 positioned about wellsite 601. Riser 602 is fluidly connected to surface structure 604.

Surface structure 604 floats on sea 606. Surface structure 604 may be, for example, a spar, a semisub, a TLP, an FPSO, a temporary or permanent storage system, a vessel, a containment apparatus, or a separator that separates components of fluid, such as gas and liquid, etc.

Opposite surface structure 604, riser 602 is fluidly connected to riser cutting tool 626. Riser cutting tool 626 comprises explosives that surround the riser to enable cutting the riser. The riser cutting tool may also have separate sets of explosives that surround the kill, choke and any other lines present along the outside of the riser. These lines may be separate from or form a part of the outside of the riser. The riser extends from beyond the riser cutting tool 626 to a blowout preventer (BOP) stack 612. Casing 614 is a riser fluidly connected to BOP stack 612. BOP stack 612 may be located at or above mudline 618. BOP stack 612 may be any BOP stack as are known in the art and commercially available, such as those provided by Cameron, Vetco-Gray, Patterson, Hydril, etc. and disclosed, for example, in U.S. Pat. No. 7,410,003, herein incorporated by reference in its entirety.

Fluid may flow from reservoir 616 through casing 614 towards surface in the direction marked by arrow 620.

During drilling or workover operations, workstring 622 may extend from surface structure 604 to casing 614. Workstring 622 is contained within riser 2 and passes through riser cutting tool 626 and BOP stack 612.

It may be desired to have multiple riser cutting tools 626 installed between riser 602 and BOP stack 612. A second riser cutting tool 626 may be included for redundancy. It may be desirable to install several sets of riser cutting tools 626 to increase flexibility of design. Riser cutting tool 626 may be installed when drilling operations commence and left on the well indefinitely and may be removed only when the well is decommissioned or when certain portions of riser cutting tool 626 need to be repaired or replaced.

Figure 2A:
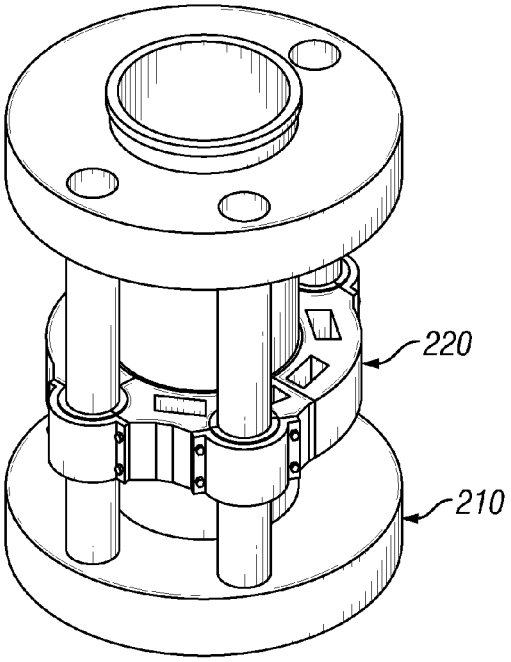
FIGS. 2A, 2B, and 2C depict an embodiment of the riser cutting tool.

FIG. 2 provides a schematic view of the internals of one embodiment of the riser cutting tool 626. FIG. 2A depicts a riser section 210 with a riser cutting tool 220 installed. As can be seen from the figure, the riser cutting tool also includes sections that surround the choke, kill and boost lines external to the riser.

Figure 2B:
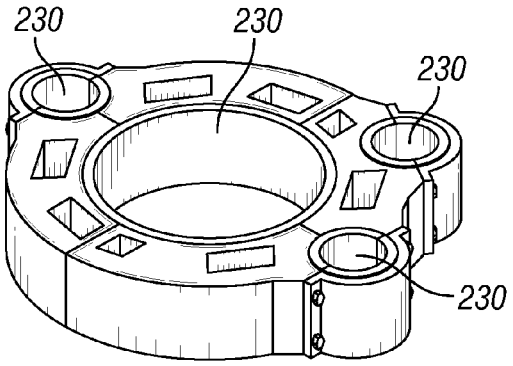
Figure 2C:
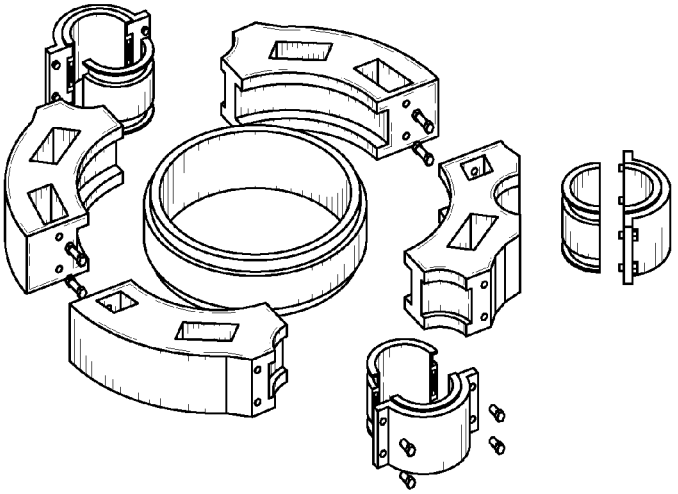

FIG. 2B depicts an embodiment of a riser cutting tool. The figure shows the location of the explosives 230 in the riser cutting tool. FIG. 2C is an exploded view of the same riser cutting tool showing how it could be built to allow easy installation on a riser.

In one embodiment, there is disclosed a method of separating a riser, comprising providing a riser having an inner and an outer surface, a circumference of said outer surface, a longitudinal axis and a first end and a second end; radially surrounding said riser with an explosive material, wherein said explosive material is capable of generating a high-velocity plasma jet in response to an activation signal, and wherein said explosive material comprises an electrically conductive layer; transmitting said activation signal to said explosive material; generating said high-velocity plasma jet; and separating said riser into a first portion comprising said first end and a second portion comprising said second end when said high-velocity plasma jet penetrates said outer surface of said riser and exits said inner surface of said riser. In some embodiments, the method also includes securing said first end of said riser. In some embodiments, the method also includes completing an electrical circuit along said electrically conductive layer of said explosive material. In some embodiments, the method also includes providing a shock mitigator and activating said shock mitigator before said generating said high-velocity plasma jet step. In some embodiments, the shock mitigator is a bubble curtain formed by injecting an inert gas into a fluid. In some embodiments, the method also includes allowing said second portion of said riser to travel away from said first portion. In some embodiments, the riser is positioned above a wellsite, wherein said wellsite comprises a well flowing a produced fluid at a first rate and a flow control device connected to said well. In some embodiments, the method also includes closing said flow control device after said second portion of said riser has traveled away from said first portion. In some embodiments, the flow control device is a blowout preventer ram.

In some embodiments, the method includes providing a containment housing surrounding the explosive material wherein the containment housing can withstand the generating said high-velocity plasma jet step without being substantially damaged. In some embodiments, the method includes using explosive material in the form of a linear charge. In some embodiments, the method includes using explosive material in the form of shaped charges. The linear or shaped charges may be any type of charge known to one of ordinary skill in the art. In some embodiments, the method includes locating the explosive material in a self-contained charge carrier. The carrier may be made of any material, but it is preferably made of a composite material. In some embodiments, the shaped charges may be located in more than one geometric plane perpendicular to the longitudinal axis of the riser. In some embodiments, the shaped charges may be positioned at an angle such that the high-velocity plasma jet contacts the outer surface of the riser at an angle that is not perpendicular to the longitudinal axis of the riser. In some embodiments, the shaped charges may be positioned at an angle such that the high-velocity plasma jet contacts the outer surface of the riser at an angle to the longitudinal axis of the riser of from 45 to 89 degrees.

In another embodiment, there is disclosed a riser cutting tool for separating a riser, including: a riser having an inner and an outer surface, a circumference of said outer surface, a longitudinal axis, and a first end and a second end; an explosive material, said explosive material radially surrounding said riser; a self-contained charge carrier, wherein at least a portion of said explosive material is contained within said charge carrier; and a trigger adapted to send an activation signal to said explosive material. In some embodiments, the explosive material is in the form of shaped charges. In some embodiments, the tool includes a containment housing surrounding the explosive material that is sufficient to withstand a high velocity plasma jet generated by the explosive material and the vibrations, and shocks caused by the explosion. In some embodiments, the charge carrier is made of a composite material. In some embodiments, the shaped charges in the tool are located in more than one geometric plane perpendicular to the longitudinal axis of the riser. The shaped charges may be located in more than two geometric planes. In some embodiments, the shaped charges are positioned at an angle such that a high-velocity plasma jet generated by the shaped charges will be directed towards the outer surface of the riser at an angle that is not perpendicular to the longitudinal axis of the riser. In some embodiments, the shaped charges are positioned at an angle such that a high-velocity plasma jet generated by the shaped charges will be directed towards the outer surface of the riser at an angle to the longitudinal axis of the riser of from 45 to 89 degrees. In some embodiments, the trigger uses direct hydraulic means to send the activation signal. In some embodiments, the trigger uses wireless transmission means selected from the group consisting of acoustic, direct sight sonar and electromagnetic transmission to send the activation signal.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

The invention claimed is:

1. A method of separating a riser, comprising:

providing a riser having an inner and an outer surface, a circumference of said outer surface, a longitudinal axis, a first end and a second end, and choke, kill, and boost lines;

radially surrounding said riser and said choke, kill, and boost lines with an explosive shaped charge material, wherein said explosive shaped charge material is capable of generating a high-velocity plasma jet in response to an activation signal, and wherein said explosive shaped charge material comprises an electrically conductive layer;

transmitting said activation signal to said explosive shaped charge material;

generating said high-velocity plasma jet; and separating said riser into a first portion comprising said first end and a second portion comprising said second end when said high-velocity plasma jet penetrates said outer surface of said riser and exits said inner surface of said riser.

2. The method of claim 1, further comprising securing said first end of said riser.

3. The method of claim 1, further comprising completing an electrical circuit along said electrically conductive layer of said explosive shaped charge material.

4. The method of claim 1, further comprising providing a shock mitigator and activating said shock mitigator before said generating said high-velocity plasma jet step.

5. The method of claim 4, wherein said shock mitigator is a bubble curtain formed by injecting an inert gas into a fluid.

6. The method of claim 1, further comprising allowing said second portion of said riser to travel away from said first portion.

7. The method of claim 1, wherein said riser is positioned above a wellsite, wherein said wellsite comprises a well flowing a produced fluid through said riser.

8. The method of claim 1, further comprising providing a containment housing surrounding the explosive shaped charge material wherein the containment housing can withstand the generating said high-velocity plasma jet step without being substantially damaged.

9. The method of claim 8, wherein the explosive shaped charge material is located in a self-contained charge carrier made of composite material.

10. The method of claim 9, wherein the explosive shaped charge material is located in more than one geometric plane perpendicular to the longitudinal axis of the riser.

11. The method of claim 8, wherein the explosive shaped charge material is positioned at an angle such that the high-velocity plasma jet contacts the outer surface of the riser at an angle that is not perpendicular to the longitudinal axis of the riser.

12. The method of claim 8, wherein the explosive shaped charge material is positioned at an angle such that the high-velocity plasma jet contacts the outer surface of the riser at an angle to the longitudinal axis of the riser of from 45 to 89 degrees.

13. The method of claim 1 wherein the explosive shaped charge material is sufficient to separate a riser having an outer diameter of at least 16 inches.

* * * * *